United States Patent [19]

Burt et al.

[11] Patent Number: 4,584,800

[45] Date of Patent: Apr. 29, 1986

[54] BUILDING STRUCTURE INCLUDING A POLYHYPARIC SURFACE

[75] Inventors: Michael Burt, Haifa; Eli Kent, Herzlia; Ami Grasman, Haifa, all of Israel

[73] Assignee: Morphore Ltd., Kfar Shmariahu, Israel

[21] Appl. No.: 352,343

[22] Filed: Feb. 25, 1982

[30] Foreign Application Priority Data

Mar. 13, 1981 [IL] Israel ..... 62353

[51] Int. Cl.[4] ..... E04B 1/32; E04B 1/72

[52] U.S. Cl. ..... 52/63; 52/80

[58] Field of Search ..... 52/80, 81, DIG. 10, 52/63, 222

[56] References Cited

U.S. PATENT DOCUMENTS

| | | | |
|---|---|---|---|
| 2,928,360 | 3/1960 | Heine | 52/80 |
| 2,961,802 | 11/1960 | Mongan | 52/80 |
| 3,232,806 | 2/1966 | Widmer | 52/80 |
| 3,252,469 | 5/1966 | Peake | 52/80 |
| 3,757,478 | 9/1973 | Pryor | 52/80 |
| 3,931,697 | 1/1976 | Pearce | 52/80 |
| 3,984,950 | 10/1976 | Hildebrand | 52/80 |

*Primary Examiner*—Henry E. Raduazo

*Attorney, Agent, or Firm*—Browdy and Neimark

[57] ABSTRACT

A building structure comprising at least one polyhyparic surface formed of a continuous tensioned web. The continuous tensioned web may be coupled to structural elements which extend only along the periphery of the web. A building structure formed of a plurality of polyhyparic surfaces arranged to have common structural members along their peripheries is also described.

3 Claims, 17 Drawing Figures

BUILDING STRUCTURE INCLUDING A POLYHYPARIC SURFACE

FIELD OF THE INVENTION

The present invention relates to building structures generally and more particularly to building structures which are based on web materials.

BACKGROUND OF THE INVENTION

Building structures based on web materials are well known in the art. The most basic structures of this type are tents wherein a web material is secured over a frame and tensioned with respect thereto. More complex building structures are also known employing web materials. These are generally characterized in that the web is tensioned so as to lie in a plane and is surrounded by structural elements with respect to which it is tensioned.

Complex geometrical shapes have been realized in building structures formed of tensioned webs by combining a plurality of discrete planar webs, each surrounded by its supporting structure, in a three-dimensional geometrical arrangment. Such structures have also been realized by the use of rigid materials instead of tensioned web materials.

Building structures based on web materials which are arranged in strips and tensioned along vertically disposed arcs are also known. These suffer from significant difficulties associated with difficulties in maintaining the webs at a required tension.

SUMMARY OF THE INVENTION

The present invention seeks to provide a building structure based on web materials and having a relatively large uninterrupted web surface defining a complex geometrical shape, formed of a plurality of identical modular elements.

There is thus provided in accordance with an embodiment of the present invention a building structure comprising at least one polyhyparic surface formed of a continuous tensioned web.

Further in accordance with an embodiment of the present invention the continuous tensioned web is coupled to structural members only along its periphery.

Additionally in accordance with an embodiment of the present invention the building structure is formed of a plurality of polyhyparic surfaces arranged to have common structural members along their periphery.

Further in accordance with an embodiment of the present invention the polyhyparic surface is formed of a plurality of identical modular elements each of which is a hyparic surface.

Additionally in accordance with an embodiment of the present invention the identical modular elements are formed of commercially available widths of web material by a technique of tapering while seaming.

Further in accordance with an embodiment of the present invention there is provided for use with building structures in which parallel webs are arranged and mounted between arc type ribs, selectable ventilation apparatus comprising web material disposed over the ribs and movable parallel thereto such that selectable positioning of the web material provides a selected amount of exposure in the region of the ribs.

Additionally in accordance with an embodiment of the present invention there is provided apparatus for securing web material under tension comprising an elongate member arranged with respect to the web material such that forces transmitted along the web material are transmitted thereto substantially continuously therealong and perpendicularly thereto and apparatus for anchoring the elongate member at discrete locations therealong.

Further in accordance with an embodiment of the invention, the elongate member is sufficiently rigid such that it does not deform in response to the forces applied thereto at the discrete locations.

Additionally in accordance with an embodiment of the present invention the elongate member is inserted into a sleeve formed in the web and the sleeve is slidable with respect to the elongate member so as to arrange itself such that forces therealong are equalized and arranged perpendicular to the elongate member.

Further in accordance with an embodiment of the present invention wherein the securing apparatus described above is used in a building structure, a flap member is associated with the web and extends therebelow to a bottom surface for enclosing the building structure. The flap member may be suitably weighted if desired.

Still further in accordance with an embodiment of the present invention there is provided a building structure which employs web material including web material of a first higher tensile strength arranged along lines wherein significant tensile forces are applied and web material of a second lower tensile strength arranged wherein significant tensile forces are not applied.

Additionally in accordance with the present invention reinforcing ribs for a building structure employing web material are constructed integrally with the web material by reinforcement thereof with additional layers of web material along desired axes.

Further in accordance with an embodiment of the present invention there is provided a technique for producing curved rigid building structures comprising the steps of providing a building structure comprising a continuous tensioned web; and applying a coating to the web for providing a rigid building structure including the web.

BRIEF DESCRIPTION OF THE DRAWINGS

The present invention will be more fully understood and appreciated from the following detailed description taken in conjunction with the drawings in which.

DETAILED DESCRIPTION OF THE INVENTION

Figure 1A:
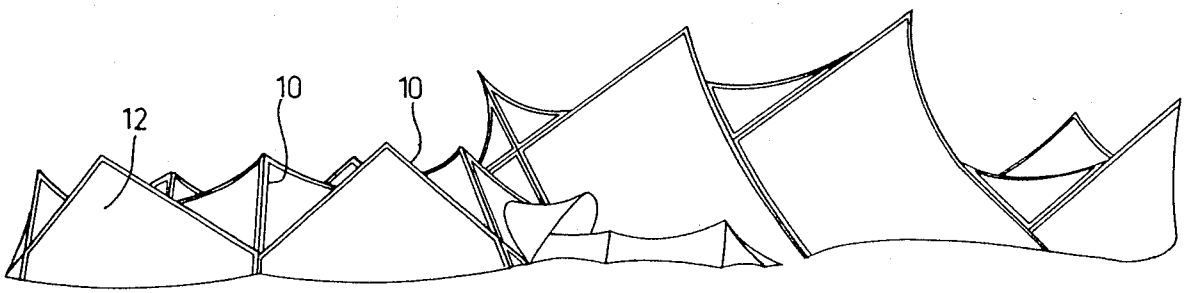
FIGS. 1A and 1B are pictorial illustrations of a building structure comprising a plurality of polyhyparic surfaces.
Figure 1B:
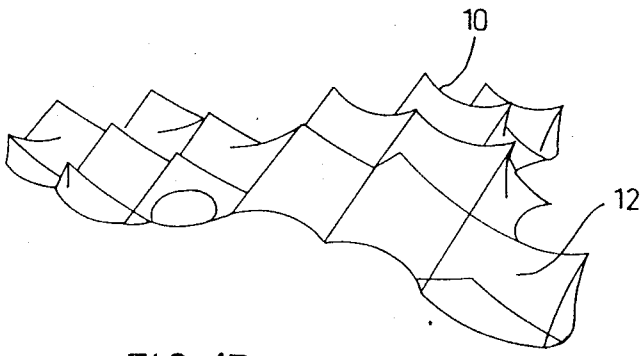

Reference is now made to FIGS. 1A and 1B which illustrate a building structure comprising a plurality of polyhyparic surfaces. Generally speaking, the building structure comprises support struts, typically in the form of poles which support the raised corners as well as the edges of the individual polyhyparic surfaces. These poles are indicated by reference numeral 10, while the web material which is supported thereonto is indicated by reference numeral 12.

The unit structure from which building structures are constructed according to the present invention is a polyhypar, otherwise known as a hyperbolic paraboloid or alternatively as a parabolic hyperboloid. This geometrical configuration is well known although not in the area of building structures. There are a variety of different possible configurations for the polyhypar, all of which are considered to be within the scope of the present invention.

The particular configuration of polyhypar employed in the illustrated preferred embodiment is a six cornered surface having three raised corners interspersed with three low corners. The modular construction of the building structure of FIGS. 1A and 1B can be seen clearly in FIG. 2A in which the individual polyhypars are indicated by reference numeral 14.

Figure 2A:
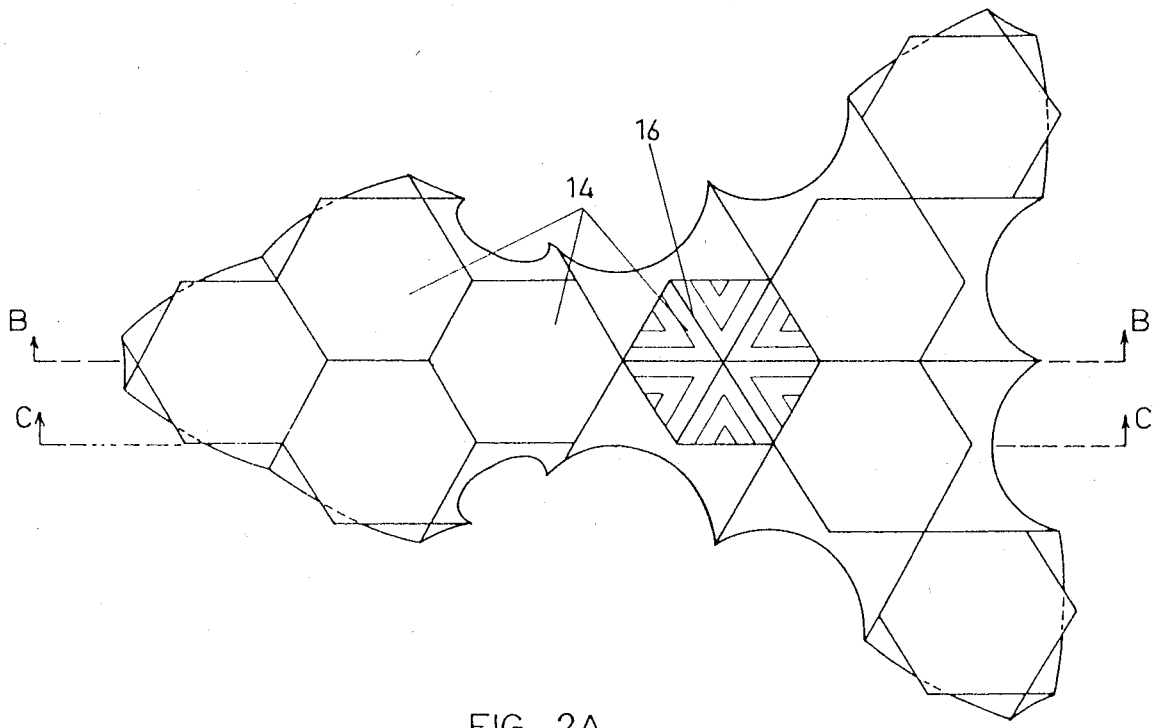
FIGS. 2A, 2B and 2C are respective top view and sectional view illustrations of the building structure of FIGS. 1A and 1B, which illustrate the construction from a plurality of identical modular elements.
Figure 2C:
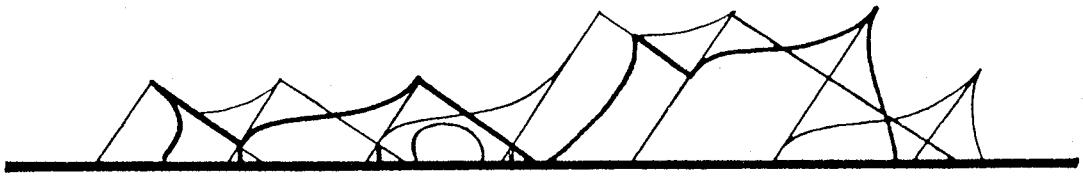
Figure 2B:
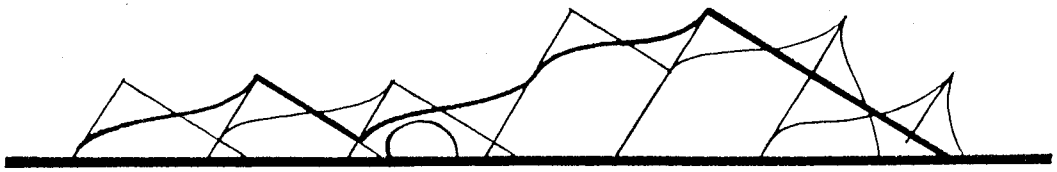

The sectional illustrations of FIGS. 2B and 2C taken along respective lines B—B and C—C indicate the overall configuration of the building structure at these locations. It is appreciated that the lines in FIG. 2A which outline the individual polyhypars 14 represents. struts 10 onto which the web material 12 is secured. FIG. 2A also indicates for a single polyhypar 16 the seams of web material which is joined to define the polyhyparic surface. This construction will now be described in greater detail with reference to FIGS. 3A–3C.

Figure 3C:
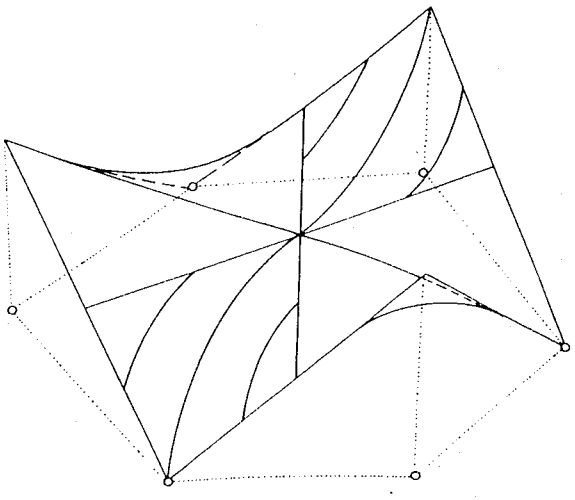
FIGS. 3A, 3B and 3C are respective plan and pictorial view illustrations of a modular hyparic surface employed in the invention.
Figure 3B:
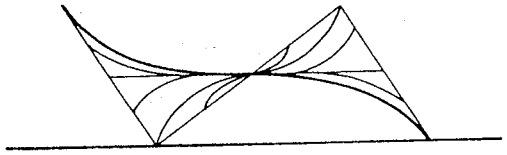
Figure 3A:
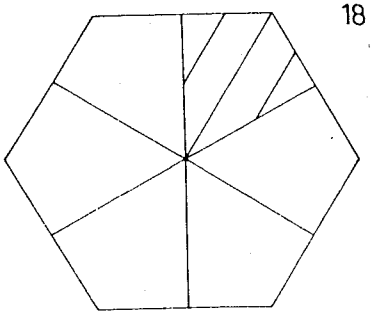

FIG. 3A shows a polyhypar in plan view and indicates that it is formed in the illustrated embodiment of six identical sections 18. It is a particular feature of the present invention that the polyhypar is formed of a continuous, albeit seamed, expanse of web material and does not require any rigid structure except at its periphery. The configuration and curved nature of the polyhypar and of curved sections 18 may be appreciated from the illustrations of FIGS. 3B and 3C.

Figure 4A:
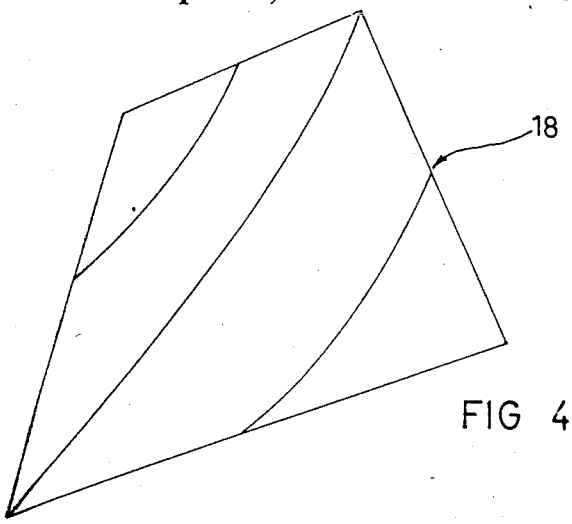
FIGS. 4A and 4B illustrate the construction of a portion of the hyparic surface of FIGS. 3A–C.
Figure 4B:
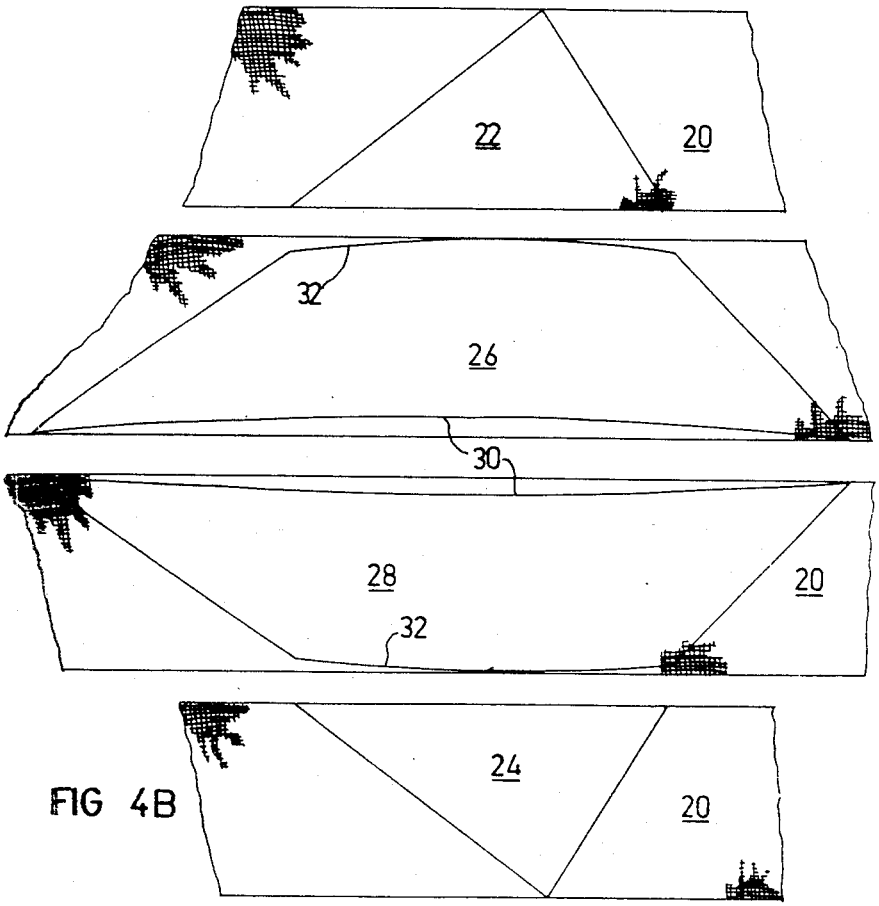

It is noted from a consideration of FIGS. 3A–3C that each of identical sections 18 is formed of a plurality of strips of web material. FIG. 4A shows a section 18 in perspective view, indicating its curvature. FIG. 4B illustrates the four components of each section 18 and indicates how they are cut from strips 20 of web material. It is noted that while triangular outer components 22 and 24 extend to the full width of the strip, the interior components 26 and 28 are tapered along both their side seams, indicated by reference numerals 30 and 32 respectively on each of components 26 and 28. This tapering provides the desired curvature to sections 18 when components 22 and 24 are joined together along the indicated seams.

Each of sections 18 is a hyparic surface. Sections 18 and indeed all of web material 14 may be formed of any suitable web material such as canvas, plastic or a composite material.

Figure 5:
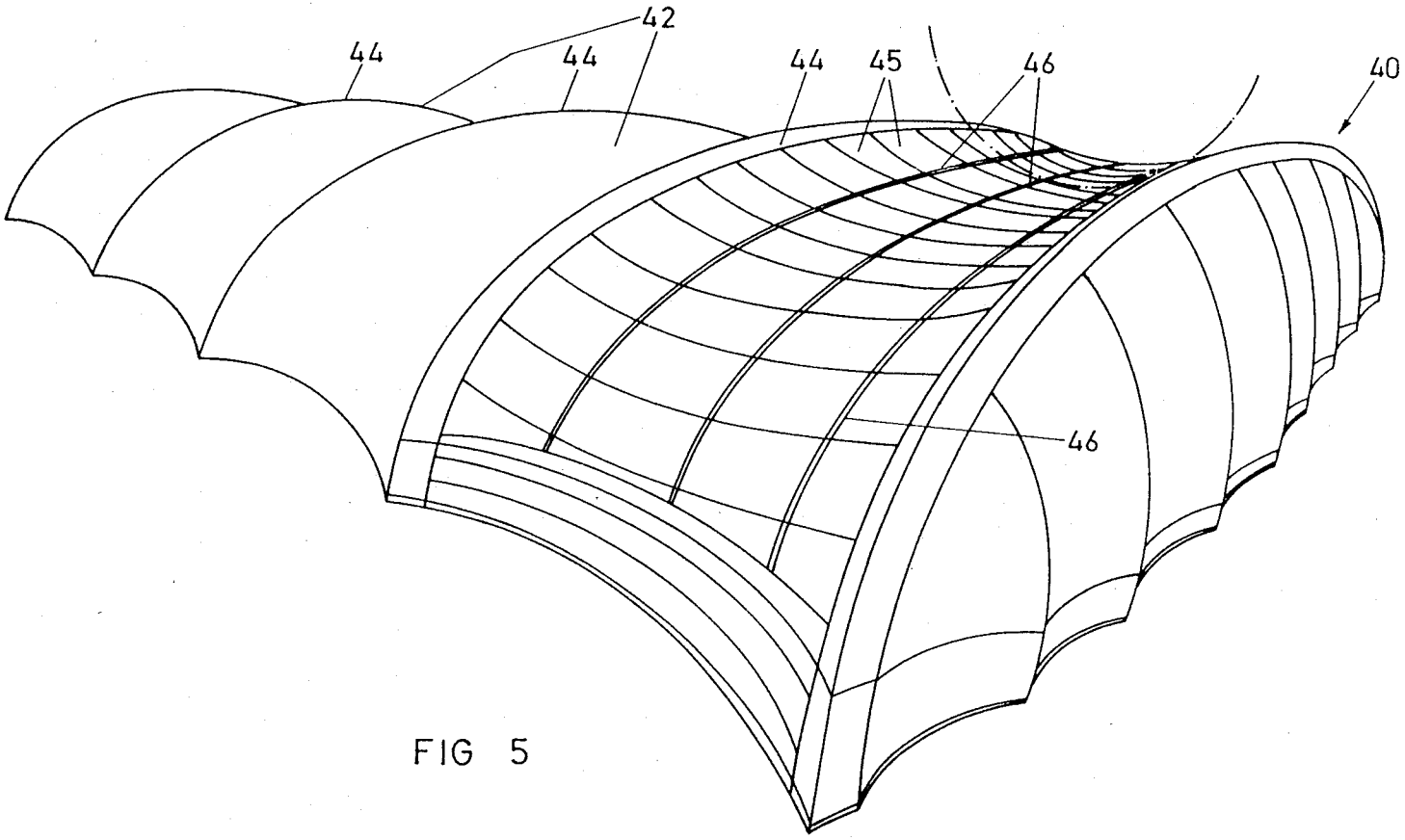
FIG. 5 is an illustration of a building structure comprising a plurality of parallel webs and employing various embodiments of the present invention.

Reference is now made to FIG. 5 which illustrates a building structure 40 comprising a plurality of parallel webs 42 which are mounted and arranged between generally parallel arc-type ribs 44. It is a particular feature of the embodiment of the invention illustrated in FIG. 5 that the webs 42 may be formed of different strengths of web material in order to realize net economy in web material. Thus in accordance with the present invention webs 42 comprise a relatively weak web material 45 along which are sewn at predetermined intervals reinforcing strips 46 of the same or different materials for handling expected loads in terms of the weight of the web material and externally generated forces such as wind. As seen in FIG. 5, the reinforcing strips may extend in a grid arrangement.

Figure 6A:
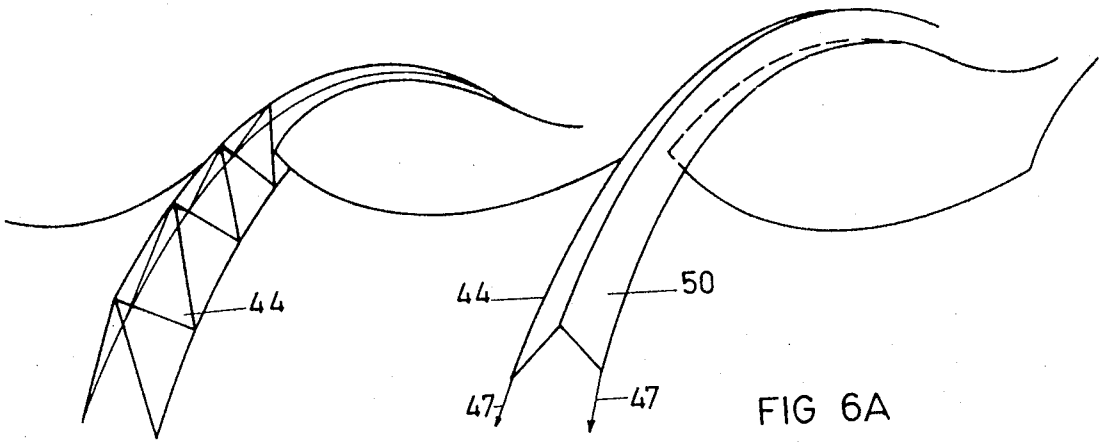
FIGS. 6A and 6B are respective pictorial and sectional views of the top of the structure of FIG. 5 illustrating one type of ventilating apparatus.
Figure 6B:
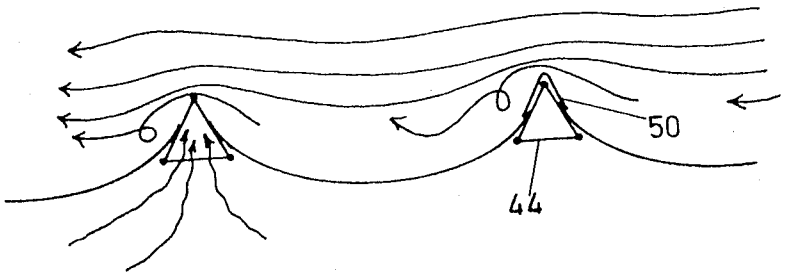

Reference is now made to FIGS. 6A and 6B which illustrate details of a ventilating arrangement for the building structure of FIG. 5 constructed and operative in accordance with one embodiment of the present invention.

FIG. 6A shows two adjacent arc-type web supporting ribs 44, one of which is covered with an elongate cover 50 of a web material and the other of which is uncovered. FIG. 6B is a sectional illustration of the air flows in the two alternative arrangements. Where the web is uncovered, the transverse flow of air, i.e. wind, past the rib on the outside of the enclosure operates to draw air out of the enclosure by means of the Bernouilli effect. Where the web is covered no such occurance takes place.

In accordance with the embodiment of the invention illustrated in FIGS. 6A and 6B a movable cover formed of an elongate strip of web material may be movably secured over the ribs 44 and secured thereonto by tensioned cables 47 along the elongate sides of the cover. By drawing the cables, which extend beyond the covers in one direction or the other, the cover can be drawn over most of the rib or removed therefrom at will.

Figure 7A:
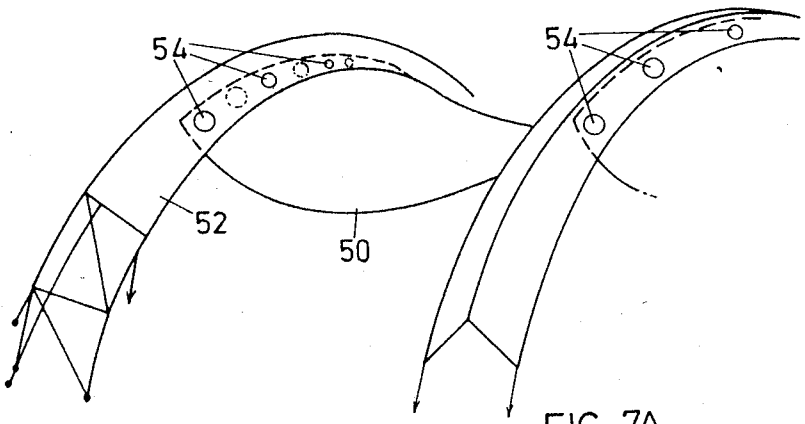
FIGS. 7A and 7B are respective pictorial and sectional views of the top of the structure of FIG. 5 illustrating another type of ventilating apparatus.
Figure 7B:
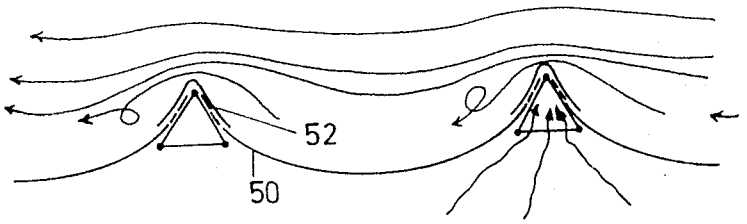

FIGS. 7A and 7B illustrate an alternative arrangement of movable cover for the ribs 44. Here there are provided two covers 50 and 52. The inner cover may conveniently be provided by a continuation of the two adjacent parallel webs and is thus fixed to the rib while the outer cover 52 is movable along the rib relative thereto in a manner similar to that described hereinabove in connection with FIGS. 6A and 6B. Both covers 50 and 52 are formed with ventilation apertures 54 such that when the apertures are in phase, ventilation is provided as indicated in FIG. 7B, and when the apertures are out of phase, no ventilation is provided. This arrangement has the advantage that a relatively small movement of the outer cover 52 relative to the inner cover 54 is required to effect a change from no ventilation to maximum ventilation.

Figure 8:
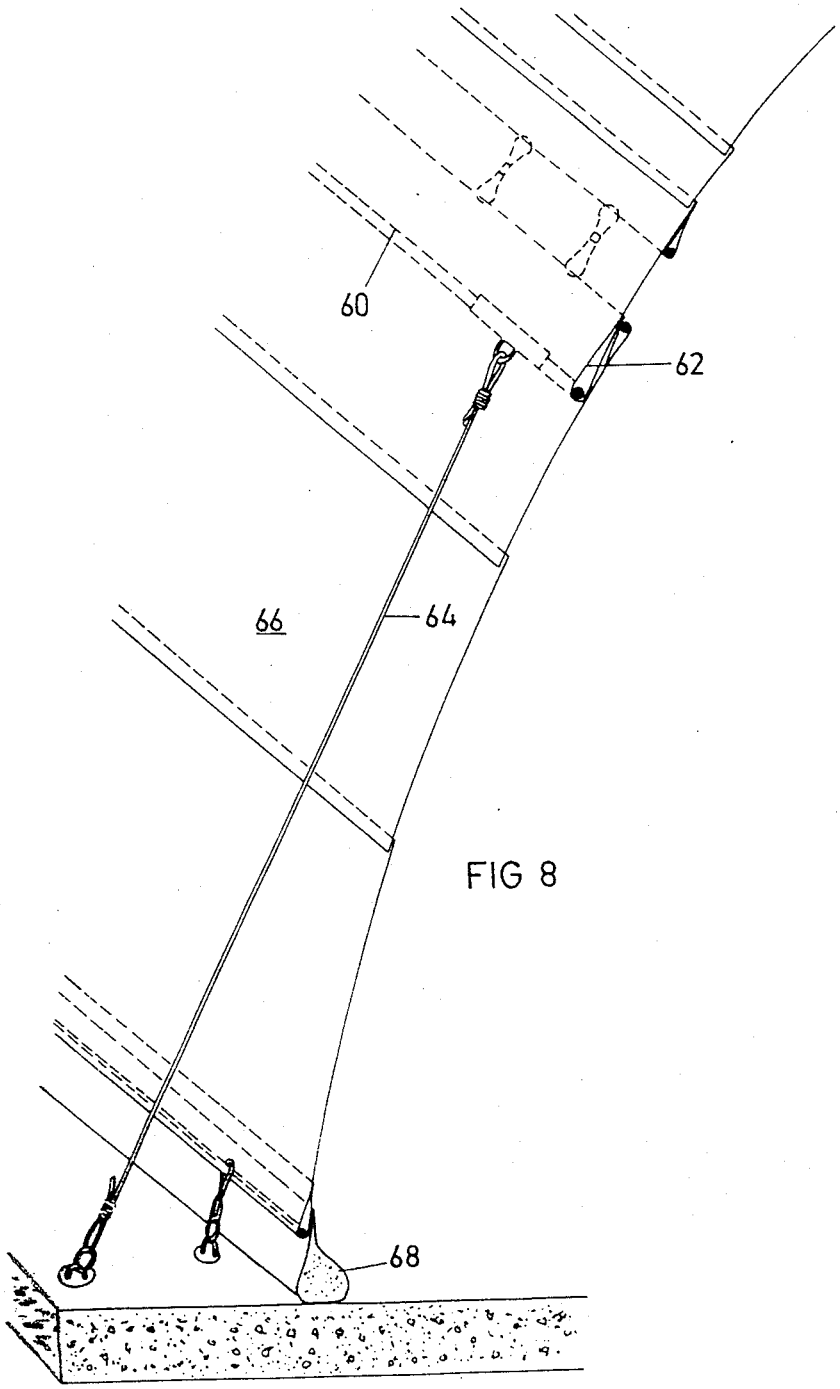
FIG. 8 is a partially sectional pictorial illustration of web material securing apparatus constructed and operative in accordance with an embodiment of the present invention.

Reference is now made to FIG. 8 which illustrates apparatus for securing the edge of web material constructed and operative in accordance with an embodiment of the present invention and comprising an elongate member 60, such as a rod or a cable, which is threaded into a sleeve 62 defined at the edge of a portion of web material. The arrangement is such that the sleeve of web material is slidable with respect to the elongate member such that it can arrange itself to equalize forces and allow the elongate member to be arranged generally perpendicular to the forces.

In the illustrated embodiment, where the securing apparatus is employed as part of a building structure, the elongate member 60 is mounted relatively high high from the ground surface and is connected to the ground surface by means of a plurality of spaced cables 64 arranged at discrete locations along the elongate member. The elongate member is selected to have sufficient rigidity so as not to become significantly deformed at the discrete locations.

In the illustrated embodiment a flap member 66 is mounted onto or adjacent the elongate member 60 and extends therebelow to the floor surface to provide desired environmental sealing. A weight 68 may be employed for maintaining the flap member 66 in desired tension and in sealing contact with the floor surface.

Figure 9:
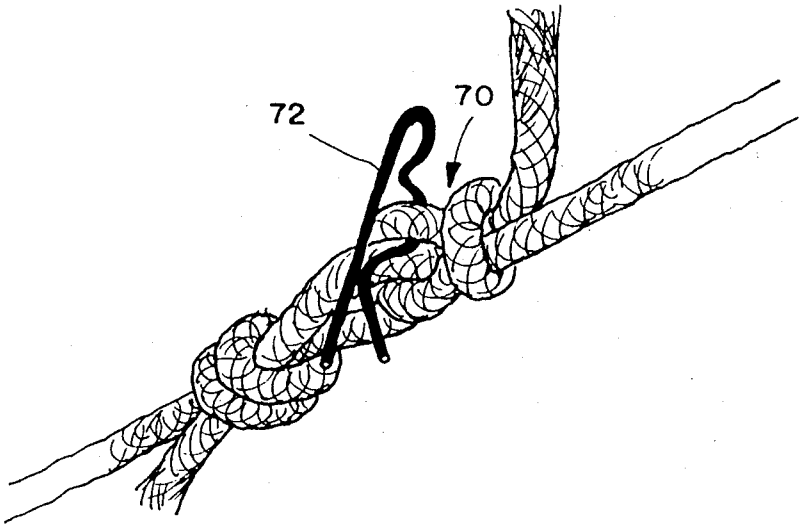
FIG. 9 is a pictorial illustration of a knot and a securing pin useful in the securing apparatus of FIGS. 8A and 8B.

Reference is now made to FIG. 9 which illustrates an easy to tie slip knot 70 which is employed together with a retaining pin for securing tensioned cables together. One application of this knot and the retaining pin 72 is in securing the side cables of the arc rib cover 50.

It will be appreciated by persons skilled in the art that the invention is not limited to what has been particularly shown and described hereinabove. Rather the scope of the present invention is defined only by the claims which follow:

We claim:

1. A building structure comprising at least one polyhyparic surface formed of a continuous tensioned web, said at least one polyhyparic surface being formed of a plurality of identical modular hyparic web elements which are seamed together to define a continuous expanse of web material and structural means for supporting said at least one polyhyparic surface and including support means disposed along the periphery of said at least one polyhyparic surface, there being no rigid structure joining the individual hyparic elements of said at least one polyhyparic surface.

2. A building structure according to claim 1 and comprising a plurality of polyhyparic surfaces arranged to have common structural members along their periphery.

3. A building structure according to claim 1 and wherein said identical modular elements each comprise elements which are cut from commercially available widths of web material.

* * * * *